US012486857B2

(12) United States Patent
Loercher et al.

(10) Patent No.: US 12,486,857 B2
(45) Date of Patent: Dec. 2, 2025

(54) FAN HAVING A STEP DIFFUSER

(71) Applicant: ZIEHL-ABEGG SE, Künzelsau (DE)

(72) Inventors: Frieder Loercher, Braunsbach (DE); Andreas Gross, Kirchensall (DE)

(73) Assignee: ZIEHL-ABEGG SE, Künzelsau (DE)

( * ) Notice: Subject to any disclaimer, the term of this patent is extended or adjusted under 35 U.S.C. 154(b) by 0 days.

(21) Appl. No.: 18/728,205

(22) PCT Filed: Dec. 22, 2022

(86) PCT No.: PCT/DE2022/200313
§ 371 (c)(1),
(2) Date: Jul. 11, 2024

(87) PCT Pub. No.: WO2023/134823
PCT Pub. Date: Jul. 20, 2023

(65) Prior Publication Data

US 2025/0084867 A1 Mar. 13, 2025

(30) Foreign Application Priority Data

Jan. 14, 2022 (DE) ..... 10 2022 200 382.9

(51) Int. Cl.

| | |
|---|---|
| ***F04D 25/06*** | (2006.01) |
| ***F04D 29/28*** | (2006.01) |
| ***F04D 29/32*** | (2006.01) |
| ***F04D 29/44*** | (2006.01) |

(52) U.S. Cl.
CPC ..... *F04D 29/441* (2013.01); *F04D 25/06* (2013.01); *F04D 29/281* (2013.01); *F04D 29/326* (2013.01)

(58) Field of Classification Search
CPC ..... F04D 25/06; F04D 29/281; F04D 29/326; F04D 29/441
See application file for complete search history.

(56) References Cited

U.S. PATENT DOCUMENTS

| | | | | |
|---|---|---|---|---|
| 6,497,201 | B1 * | 12/2002 | Werson | F04D 13/12 123/41.12 |
| 2010/0111667 | A1 * | 5/2010 | Stagg | F04D 29/441 415/191 |
| 2021/0277910 | A1 * | 9/2021 | Heli | F04D 29/703 |
| 2022/0316496 | A1 * | 10/2022 | Froh | F01P 5/06 |

FOREIGN PATENT DOCUMENTS

| | | | |
|---|---|---|---|
| DE | 112008000850 | | 3/2010 |
| DE | 202011004708 | A1 | 7/2011 |
| DE | 102013223983 | | 5/2015 |
| DE | 202018106508 | U1 | 1/2019 |
| DE | 202018106512 | U1 | 1/2019 |
| DE | 102018128792 | | 5/2020 |
| DE | 102018128824 | | 5/2020 |
| DE | 102019220232 | | 6/2021 |
| JP | H1162898 | | 3/1999 |
| JP | 2008014302 | A | 1/2008 |
| WO | 2020015792 | | 1/2020 |

* cited by examiner

*Primary Examiner* — Audrey B. Walter
(74) *Attorney, Agent, or Firm* — FisherBroyles, LLP; Jason P. Mueller

(57) ABSTRACT

A fan, in particular an axial or diagonal fan, comprising a housing and an impeller arranged therein and driven by an electric motor and having vanes extending between a hub ring and a cover ring, wherein a step diffuser is formed in the form of an abrupt expansion of the flow cross-section in the direction of flow downstream of the impeller and after exiting the region of the cover ring.

14 Claims, 6 Drawing Sheets

FAN HAVING A STEP DIFFUSER

CROSS REFERENCE

This application is a national stage entry application under 35 U.S.C. 371 of PCT Patent Application No. PCT/DE2022/200313 filed on 22 Dec. 2022, which claims priority to German Patent Application No. 10 2022 200 382.9, filed on 14 Jan. 2022 the entire contents of each of which are incorporated herein by reference.

FIELD

The disclosure relates to a fan, in particular an axial or diagonal fan. The fan includes a housing and an impeller which is arranged therein and is rotationally driven by an electric motor. The impeller has blades which extend between a hub ring and a cover ring.

BACKGROUND

Fans forming the generic type are known in a very wide variety of designs in practice. For example, there are fans with axial wheels which do not have a cover ring and which run in housings. In this case, a sharp rise in the noise level may be registered under rising pressures or pressure losses in the housing. As pressures rise, the noise level increases quite considerably.

For fans with freely running diagonal wheels, problems occur if little lateral space is available. In addition, such fans are problematic in terms of power and noise level at rather low pressures.

As regards the general prior art, reference should be made merely by way of example to WO 2020/015792 A1.

SUMMARY

The present disclosure is based on the object of substantially eliminating, but at least reducing, the disadvantages or problems occurring in the prior art. The aim especially is to provide particularly quiet and efficient fans which have a particularly insensitive reaction to increased pressures in respect of noise generation and an increase in pressure. In addition, the fans according to the disclosure are intended to differ from competitive products.

The above object is achieved, in an embodiment, by the features of claim 1. According thereto, in the case of the fan of the type in question, a "step diffuser" in the form of an abrupt expansion in the flow cross section is formed downstream of the impeller and downstream of the outlet from the region of the cover ring in the flow direction. According to the disclosure, it has been recognized that the provision of a step diffuser in the form of an abrupt expansion in the flow cross section very substantially eliminates the disadvantages occurring in the prior art. This solution appears surprisingly simple and is equally particularly effective, especially whenever increased pressures occur.

Tests have shown that a cross-sectional step associated with the step diffuser is particularly effective at a surface ratio>=105%, in particular >=110%. This involves the cross-sectional expansion in the flow channel downstream of the impeller.

The fan according to the disclosure has, in an embodiment, a cylindrical housing, wherein the step diffuser can be realized downstream of the flow outlet from the cover ring.

In an advantageous manner, the contour of the cover ring interacts with the housing contour both in relation to the main flow and in relation to the secondary flow in the fan, wherein an imaginary downstream extension of the cover ring contour does not intersect the housing inner contour.

Furthermore, it is advantageous in an embodiment if, in the case of the fan according to the disclosure, the main flow flows through an inlet nozzle into the impeller. The flow flows through the housing via inner and outer throughflow regions. A secondary flow, as a partial flow of the air emerging from the impeller, flows back between the cover ring and the contour of the housing and enters the region of the impeller again via a radial gap between the inlet nozzle and the cover ring. The secondary flow is a proportionally small partial flow of the air emerging from the impeller, which can influence the main flow in a region close to the surrounding cover ring in such a way that it stabilizes the flow there. The secondary flow regularly has heavy swirling imparted to it, as it is influenced by the rotational movement of the impeller.

A redirection device, which can have additional supporting properties, can be arranged downstream of the impeller in the flow direction. The redirection device influences the flow in the region of the step diffuser. The redirection device and the step diffuser interact in such a way that they have an effect on the secondary flow, which causes "suction" of the main flow onto the inner contour of the housing. Furthermore, it is advantageous that the flow emerging from the impeller has swirl imparted to it. In addition, the flow in the region of the step diffuser can be specifically influenced by the design of an intermediate ring of the redirection device, with the intermediate ring advantageously being aligned less axially parallel and rather at a pitch angle in relation of the axial direction. This results in a low-noise fan with a high degree of efficiency as a result of pressure recovery.

A supporting redirection device can be provided as an integral part of the housing, the housing, in an embodiment, being manufactured by plastics injection molding. Such manufacturing of the housing is of fundamental advantage, especially for a lightweight design and favorable manufacturing of the housing.

The supporting function for the motor and impeller can be taken on in principle by a special suspension, which is, in an embodiment, advantageously made of steel or another metallic material. The mechanical properties, in particular the stability, play a special role here.

The hub ring of the impeller can have a large central opening toward the rotor of the motor for cooling purposes, as a result of which cooling of the motor is very particularly promoted.

The ratio of the outlet diameter of the housing should not fall below a particular minimum at its outflow-side edge to the inner outlet diameter of the cover ring; in other words, the ratio should be >1.05. This characterizes the cross-sectional expansion of the flow channel downstream of the impeller. In conjunction with the advantageously approximately cylindrical inner contour of the housing, the step diffuser for the main flow is produced downstream of the impeller.

The cover ring of the impeller can extend beyond a region approximately parallel to the impeller axis or with a small pitch angle with respect to the impeller axis. Furthermore, the hub ring of the impeller may have a pronounced character with a diameter increasing in the flow direction. This also promotes the flow.

The outlet diameter of the inlet nozzle is furthermore slightly smaller than the outlet diameter at the cover ring of the impeller. This configuration is, in an embodiment, based on a ratio of outlet diameter of the housing to outlet diameter of the inlet nozzle of >1.05.

Furthermore, openings can be formed in the housing, the openings fluidically connecting the region associated with the secondary flow between the inlet nozzle or the cover ring of the impeller and the housing to a region outside the housing.

There are, then, various ways of embodying and developing the teaching of the present disclosure. To this end, reference can be made to the claims subordinate to claim 1 and to the explanation below of exemplary embodiments of a fan according to the disclosure with reference to the drawing. In connection with the explanation of the exemplary embodiments of the disclosure with reference to the drawing, in general refinements and developments of the teaching will also be explained.

DETAILED DESCRIPTION OF THE DISCLOSURE

Figure 1:
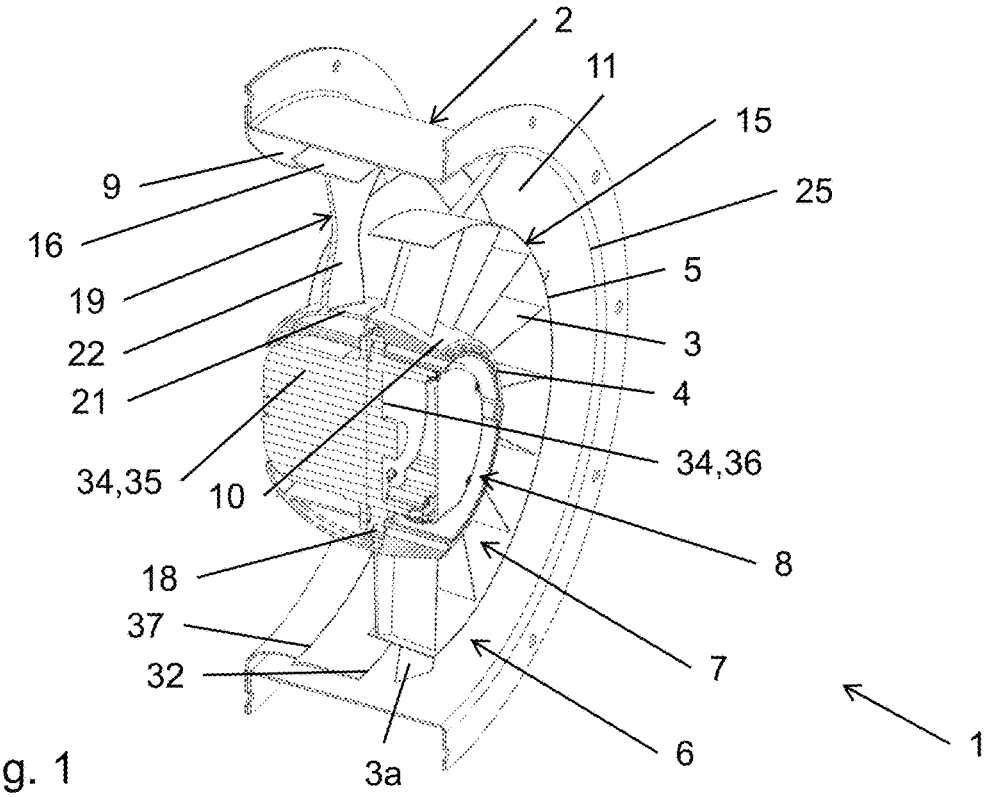
FIG. 1 shows, in a perspective view, as seen from the outflow side, and in a section at a plane through the fan axis, a fan according to the disclosure having an impeller with a surrounding cover ring in a housing with a supporting redirection device.

FIG. 1 shows, in perspective view, as seen from the outflow side, and in a section at a plane through the fan axis, a fan 1 according to the disclosure with a housing 2. A guide device 15 is, in an embodiment, manufactured integrally with the housing 2 by plastics injection molding, and includes, in the exemplary embodiment, essentially of a hub ring 4, an intermediate ring 5, guide blades 3 extending in between, and strut blades 3*a*, which extend between the intermediate ring 5 and the inner contour 11 of the housing 2.

The impeller 19 includes of a hub ring 21, a surrounding cover ring 16, and blades 22 extending in between. The impeller 22 is fastened to a hub ring 21 by means of fastening devices 30 (FIG. 2) on the rotor 35 of a motor 34, here an external rotor motor. During operation, the impeller 19, driven by the motor 34, rotates about the fan axis and thereby conveys air or another conveying medium from an inflow side to an outflow side (approximately from left to right in the view of FIG. 1).

On the inflow side, there is an inlet nozzle 9 which lies with its outflow end 37 radially within the cover ring 16 of the impeller 19, with a radial gap being formed between the inlet nozzle 9 and the cover ring 16. The inlet nozzle 9 is fastened to the housing 2 and, depending on the embodiment, can also be formed as an integral component with the housing 2. The guide device 15 is arranged downstream of the impeller 19 within the housing 2, with an air duct (outer throughflow region) 6 and thus an air flow being formed between the intermediate ring 5 of the guide device 15 and the inner contour 11 of the housing 2. Part of the air flowing from the impeller flows through the air duct 6. Another part of the air flowing from the impeller is directed through the inner throughflow region 7, which, as seen in the span width direction toward the axis, is delimited by the hub ring 4 of the guide device 15, and which, as seen in the span width direction toward the outer throughflow region 6, is delimited by the intermediate ring 5. The inner throughflow region 7 is interspersed with guide blades/guide elements 3 (e.g., 17 items, 9-23 items, in the exemplary embodiment), which stabilize the flow which is in the vicinity of the axis, has swirl imparted to it and emerges from the impeller 19 and flows into the guide device, by reducing the swirl in the flow and also backflows in the hub region. This increases the efficiency.

The hub ring 4 and the intermediate ring 5 of the guide device 15 substantially extend over the entire circumference about the axis. The hub ring 4 surrounds an inner receiving region 8, in which, for example, the drive motor 34 of the fan 1 with its stator 36 can be arranged. The flow does not pass through the receiving region 8 or a small air volume flow (0.1%-2% of the total air volume flow) flows through it in order to be able to remove the waste heat produced by the motor. In this case, the flow through the receiving region 8 can also take place in the opposite direction to the main conveying direction, in particular if it is driven by a pressure difference between the outflow side and the inflow side.

In the exemplary embodiment, the outer throughflow region 6 has a lower number of (three to eight) strut elements 3*a*, which in particular take on the static connection of the intermediate ring 5 to the housing 2. Owing to the small number of strut elements 3*a*, little additional noise is caused in this region as a result of the interaction of the flow emerging from the impeller and strut elements 3*a*. In another embodiment, not illustrated, the strut elements may be arranged at a maximum distance from the impeller, approximately in the vicinity of the outlet end of the housing or relatively close to the outflow end of the intermediate ring of the guide device.

The housing 2 including strut blade 3*a*, guide device 15 with intermediate ring 5, guide blades 3 and hub ring 4 can be manufactured integrally by plastics injection molding. The inlet nozzle 9 is then a separate part, which is attached to the housing 2 after the impeller 19 is inserted. Conversely, the inlet nozzle 9 can also be integrated integrally on the housing. The redirection device 15 together with the strut blade 3*a* is then a separate part or separate parts that are fastened to the housing 2 when the impeller 19 is placed therein.

During operation of the fan 1 there is a main flow which, in the view shown (FIG. 1), flows approximately from left to right through the inlet nozzle 9 into the impeller 19, and which then, in the meantime divided into the outer and inner throughflow regions 6 and 7, emerges again at the outflow-side edge 25 of the housing 2 from the housing 2 and thus from the fan 1. At the same time there is a secondary flow. This is a proportionally small partial flow of the air which emerges from the impeller 19 at its outflow-side edge 32 and flows back between the surrounding ring 16 of the impeller 19 and the inner contour 11 of the housing and which then enters the impeller again through the radial gap between the inlet nozzle 9 and the surrounding ring 16. The secondary flow can significantly influence the main flow in a region close to the surrounding ring 16 by stabilizing the flow there. The secondary flow regularly has swirling imparted to it, as it is already greatly influenced by the rotational movement of the impeller 19.

After the main flow emerges from the impeller 19 at its outflow-side edge 32, said flow undergoes an abrupt expansion in the flow cross section. In this respect, a step diffuser is formed downstream of the impeller 19. The cross-sectional expansion reduces the throughflow rate and thus creates an additional static pressure, which increases the degree of reaction and thus the static efficiency. Owing to the lower speeds, the noise generation in downstream components around which the flow passes, for example in the redirection device 15 with its guide elements 3, optionally strut elements 3*a* and intermediate ring 5 or also in suspensions, is also reduced.

It is a common assumption, indeed a preconception among experts, that such step diffusers have very poor efficiency in terms of their conversion of kinetic energy into pressure energy. However, there are factors that cause the step diffuser to work well. First, this is an effect of the secondary flow, which causes "suction" of the main flow onto the inner contour 11 of the housing. Secondly, there is the advantageous effect that the flow emerging from the impeller 19 has heavy swirling imparted to it. Third, the flow in the region of the step diffuser can be specifically influenced by the design of the intermediate ring 5 of the redirection device 15. In particular, the intermediate ring 5 advantageously does not run axially parallel, but at a pitch angle in relation to the axial direction.

Overall, a fan which is quiet and highly efficient, namely as a result of the pressure recovery by the step diffuser with the associated reduction in the throughflow rate, is realistic. In the exemplary embodiment, a backflow in the hub region is furthermore greatly reduced by the redirection device 15. In addition, low noise generation is ensured by a low number of strut blades 3*a*.

By provision of a step diffuser instead of a conventional diffuser, the inner contour 11 of the housing 2 can nevertheless be approximately in the shape of a cylinder jacket and does not have to have a conical contour, as is customary in the case of diffusers. This can significantly simplify the manufacturability of the housing 2, in particular in plastics injection molding, but also in sheet metal design.

Figure 2:
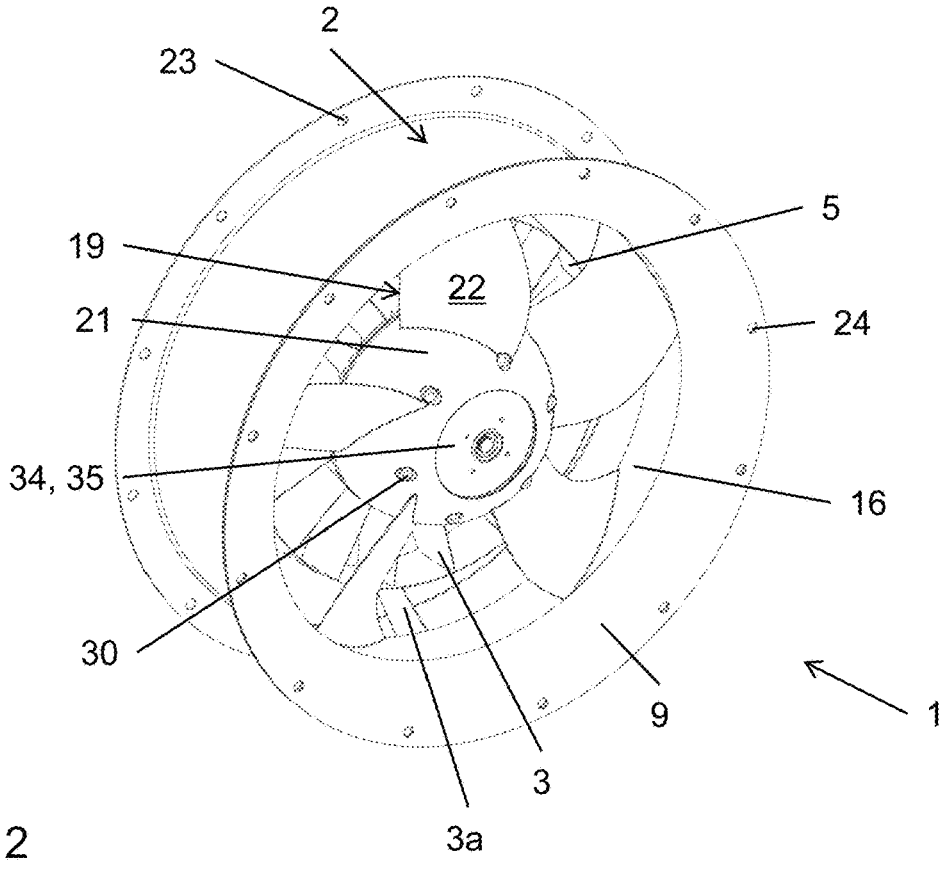
FIG. 2 shows, in a perspective view, as seen from the inflow side, the fan from FIG. 1.

FIG. 2 shows, in a perspective view, as seen from the inflow side, the fan 1 with the housing 2 according to the disclosure from FIG. 1. As a supplement to FIG. 1, it can be seen that the hub ring 21 of the impeller 19 is open over a large surface area in a central region in such a way that inflowing air at the rotor 35 of the motor 34 ensures cooling. Thus, the entire face-side surface of the rotor 35 is substantially not covered in relation to the inflow. The blades 22 of the impeller 19 are sickle-shaped rearward counter to the direction of rotation, which here runs in the clockwise direction. This means that the radial outer blade regions trail behind the radial inner blade regions in the direction of rotation. However, such an impeller may also be sickle-shaped forward, depending on the required operating point. On the housing 2, inflow-side fastening devices 24 are provided for fastening the fan 1 to an air handling system or device, for example by screws. Likewise, outflow-side fastening devices 23 for fastening the fan 1 to an air handling system or device, here too, for example, by screws, are provided on the housing 2.

Figure 3:
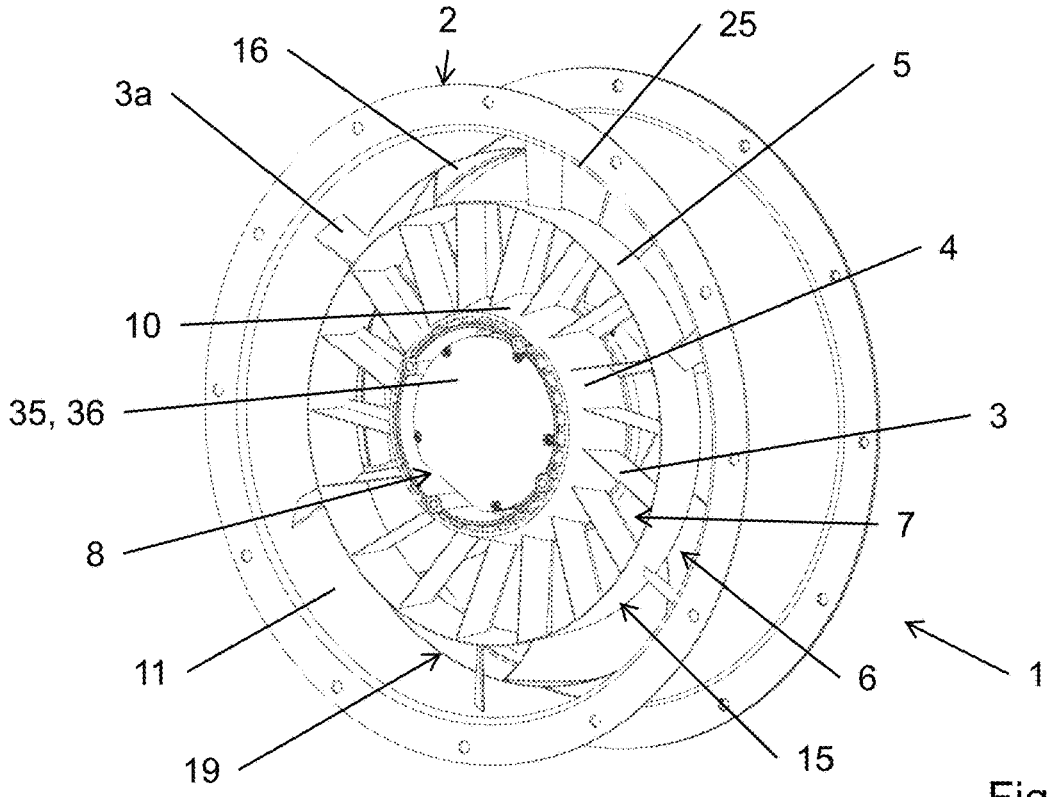
FIG. 3 shows, in a perspective view, as seen from the outflow side, the fan from FIGS. 1 and 2.

FIG. 3 shows, in a perspective view, as seen from the outflow side, the fan 1 with the housing 2 according to the disclosure from FIGS. 1 and 2. In addition to these figures, it is easily be seen that the stator 36 of the motor 35 is arranged within a receiving region 8 within the hub ring 4 of the redirection device 15. The redirection device 15 has a large number of, for example 13-23, inner guide blades 3, which suppress or at least reduce a possible return flow in the vicinity of the hub. Only a few strut blades 3*a*, for example 4-9, are arranged in the outer throughflow region 6. Here, too, the step diffuser can be seen with reference to the distance of the outflow edge 32 of the surrounding ring 16 of the impeller 19 and the inner contour 11 of the housing 2.

Figure 4:
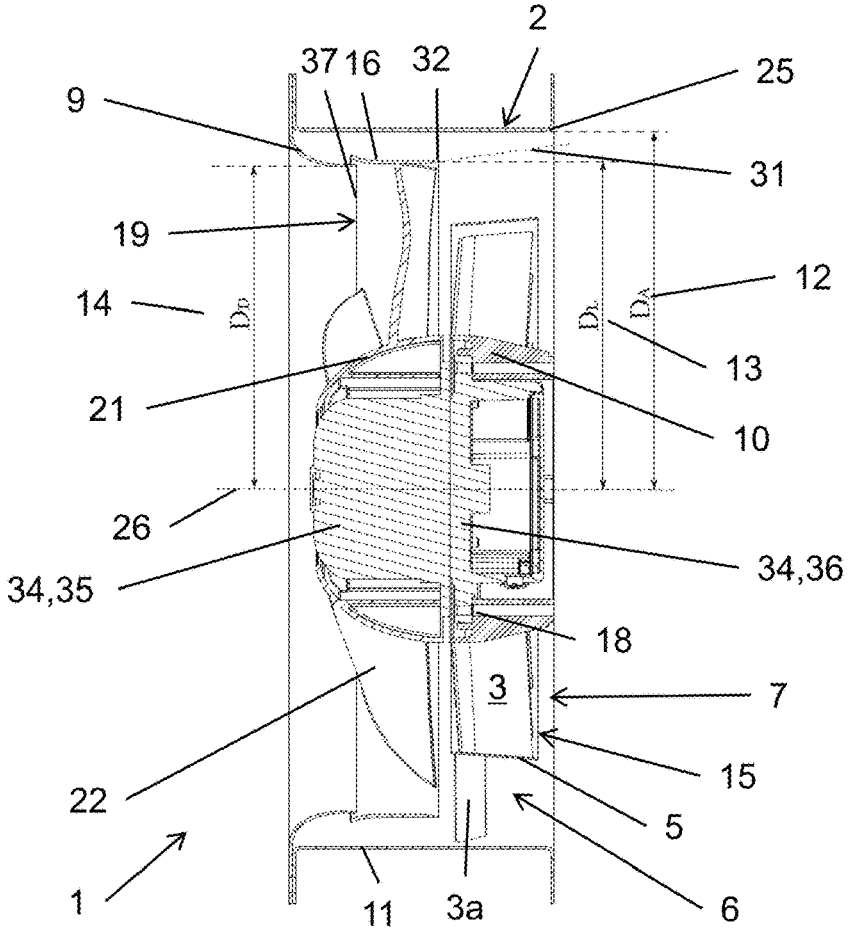
FIG. 4 shows, in a side view and in a section at a plane through the axis, the fan and the housing according to FIGS. 1, 2 and 3, with significant diameters being shown.

FIG. 4 shows, in a side view and in a section at a plane through the axis, the fan 1 and the housing 2 according to FIGS. 1, 2 and 3. In addition to FIGS. 1-3, the three diameters $D_A$ 12, $D_L$ 13 and $D_D$ 14 and a cover ring outflow direction 31 are schematically shown. With the aid of these dimensions, the step diffuser, which the housing 2 forms with the cover ring 16 of the impeller, can be readily characterized. $D_A$ 12 is the outlet diameter of the housing 2, i.e. the diameter of the housing 2 at its outflow-side edge 25. $D_L$ 13 is the inner diameter of the surrounding ring 16 at its outflow-side edge 32. $D_D$ 14 is the inner diameter of the inlet nozzle 9 at its outflow-side edge 37. The ratio $D_A/D_L>1.05$ is advantageous in an embodiment, as a result of which the cross-sectional expansion in the flow channel downstream of the impeller 19 is characterized. In conjunction with an advantageous approximately cylindrical inner contour 11 of the housing 2, a step diffuser for the main flow is produced downstream of the impeller 19.

The impeller 19 has a cover ring 16 which, in the exemplary embodiment, extends over wide regions approximately parallel to the fan axis or is positioned only at a slight angle thereto. The hub ring 21 of the impeller 19 has a pronounced conical character with a diameter increasing in the flow direction. At its outflow-side edge 32, the inner contour of the cover ring 16 is at a pitch angle with respect to the fan axis. The geometric outflow direction 31 from the impeller 19 is thus not axially parallel, but points slightly radially outward in the flow direction, approximately at an angle of 5° to 15°, as seen in a planar section. This is advantageous for the operation of the special step diffuser. In addition, the imaginary rectilinear tangential extension of the cover ring inner contour 31 (geometric outflow direction at the cover ring 16 at its outflow-side edge 32) does not intersect the inner contour 11 of the housing 2. As a result, a curvature toward the inner contour 11 of the housing 2 is impressed on the cover-ring-side limiting current line, which is advantageous for an efficient operation of the step diffuser.

The outlet diameter $D_D$ 14 of the inlet nozzle 9 is only slightly smaller than the outlet diameter $D_L$ 13 on the cover ring 16 of the impeller 19. For more diagonally pronounced impellers with more conically pronounced cover rings, $D_D$ 14 can also be distinctly smaller than $D_L$ 13. In any case, $D_D$ 14 is overall distinctly smaller than the outlet diameter $D_A$ 12, in particular is advantageously $D_A/D_D>1.05$, in an embodiment. This makes it possible, inter alia, that the contour of the inlet nozzle 9 can be fitted in a radial region between the diameters $D_D$ 14 and $D_A$ 12. As a result, the inner contour 11 of the housing 2 can be overall substantially cylindrical, and the inlet nozzle 9 finds space radially within it.

Figure 5:
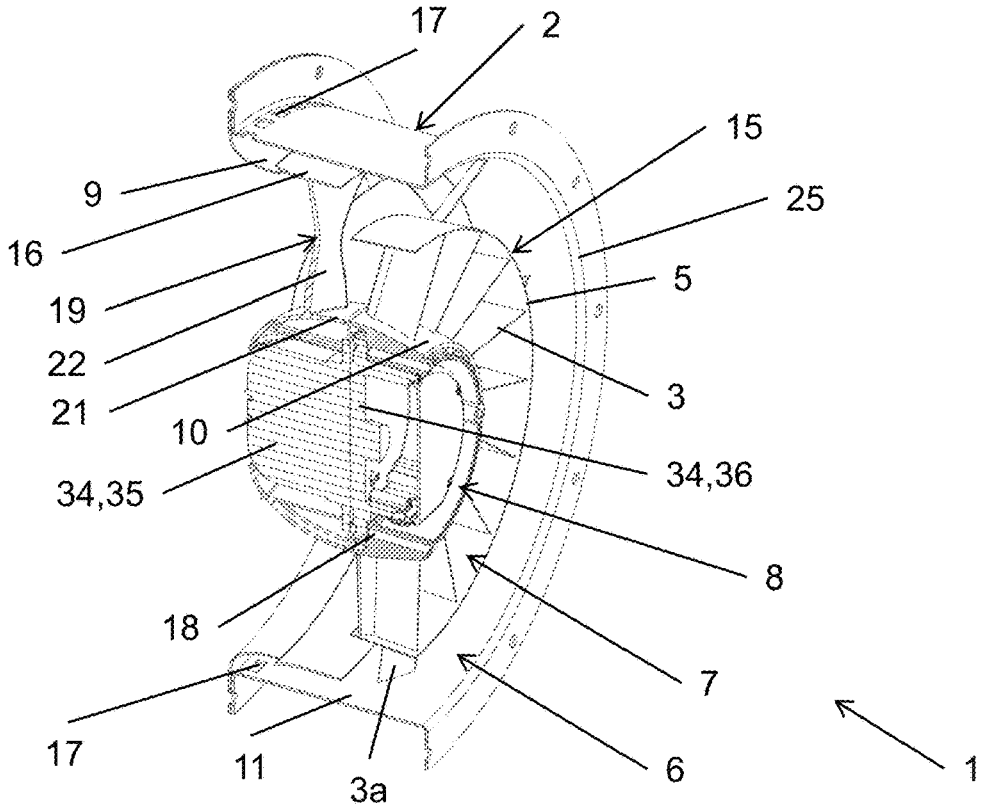
FIG. 5 shows, in a perspective view, as seen from the outflow side and in a section at a plane through the fan axis, a further embodiment of a fan according to the disclosure, with openings being provided in the housing.

FIG. 5 shows, in a perspective view, as seen from the outflow side and in a section at a plane through the fan axis, a further embodiment of a fan 1 according to the disclosure, with openings 17 being provided in the housing 2. Moreover, the embodiment is comparable to the embodiment according to FIGS. 1-4. The openings 17 connect the region associated with the secondary flow between inlet nozzle 9 and housing 2 or between cover ring 16 of the impeller 19 and housing 2 to a region outside the housing. Depending on how the fan is installed, the pressure level of the region outside the housing 2 in the region of the openings 17 can correspond to an inflow side of the fan, or to an outflow side or it can have an independent pressure level if anything decoupled from the fan 1 or its inflow side and outflow side.

It is typical that, in the region of the openings 17 outside the housing 2, flow conditions with only little swirling with respect to the fan axis or else generally low flow velocities prevail. The recirculation flow (secondary flow) described in FIG. 1 and originating from the outlet of the impeller 19, can have heavy swirling imparted to it. In this respect, a mixture of the recirculation flow to which swirling is imparted, with a low-swirl flow, which flows through the openings 17 into the recirculation area, causes a swirl correction or swirl reduction of the flow, which flows through the radial gap between inlet nozzle 9 and cover ring 16 of the impeller 19 into the impeller as secondary flow. This can be advantageous for avoiding separations on the cover ring 16 or on the blades 22 and can thus contribute to high efficiency with low noise emission.

Figure 6:
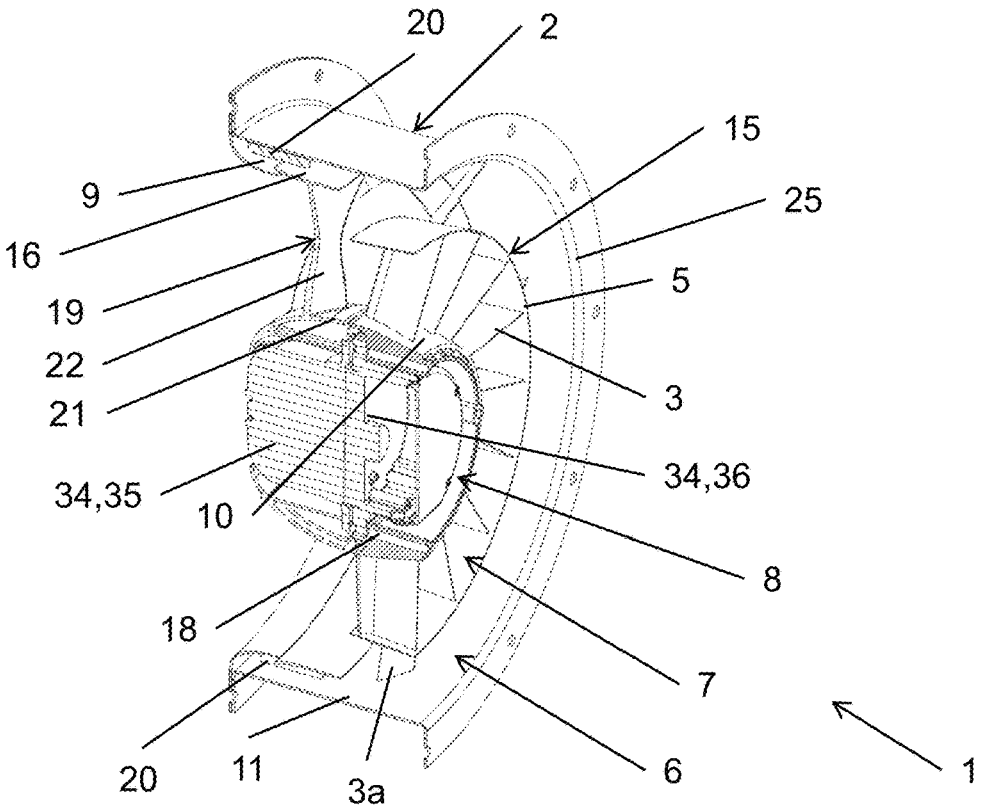
FIG. 6 shows, in a perspective view, as seen from the outflow side and in a section at a plane through the fan axis, a further embodiment of a fan according to the disclosure, with swirl correction elements being provided on the housing.

FIG. 6 shows, in a perspective view, as seen from the outflow side and in a section at a plane through the fan axis, a further embodiment of a fan 1 according to the disclosure, with swirl correction elements 20 being provided on the housing 2. They are formed axially approximately in a region of the inlet nozzle 9 and/or the cover ring 16 of the impeller 19. In the exemplary embodiment, they overlap, as seen axially, the radial gap between the inlet nozzle 9 and the cover ring 16. They protrude radially inward from the inner contour 11 of the housing 2. Alternatively, similar elements can also be attached to the inlet nozzle 9 on the side facing the housing 2. The shape of the swirl correction elements 20 can be rectilinear and parallel to the fan axis, as shown. Shapes which are curved or optimized is some other way may also be advantageous. The function of the swirl correction elements 20 is a reduction in the heavy swirling of the secondary flow, which flows through the radial gap between the inlet nozzle 9 and the cover ring 16 of the impeller 19 into the impeller 19. This can be advantageous for avoiding separations on the cover ring 16 or on the blades 22 and can thus contribute to high efficiency with low noise emission.

Figure 7:
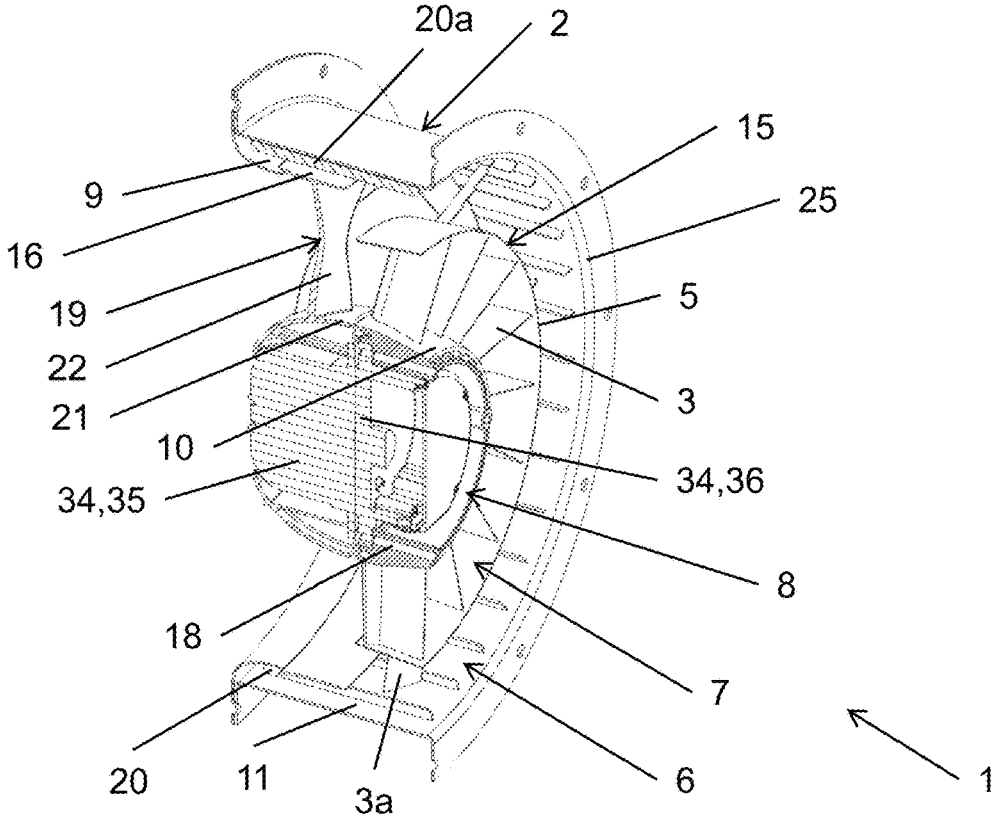
FIG. 7 shows, in a perspective view, as seen from the outflow side and in a section at a plane through the fan axis, a further embodiment of a fan according to the disclosure, with swirl correction elements on the housing extending axially beyond the impeller.

FIG. 7 shows, in a perspective view, as seen from the outflow side and in a section at a plane through the fan axis, a further embodiment according to the disclosure of a fan 1, with swirl correction elements 20*a*, which are relatively long, on the housing 2 extending axially beyond the impeller 19 or the cover ring 16 thereof. The swirl correction elements 20*a* lead to a more pronounced reduction in swirling and can also have a positive influence on the main flow which emerges from the impeller 19 and which then emerges from the housing 2 at the outflow-side edge 25. In particular, the main flow may be directed more axially parallel in order to avoid swirl components which are too high in the region of the outer contour 11 of the housing 2.

Figure 8:
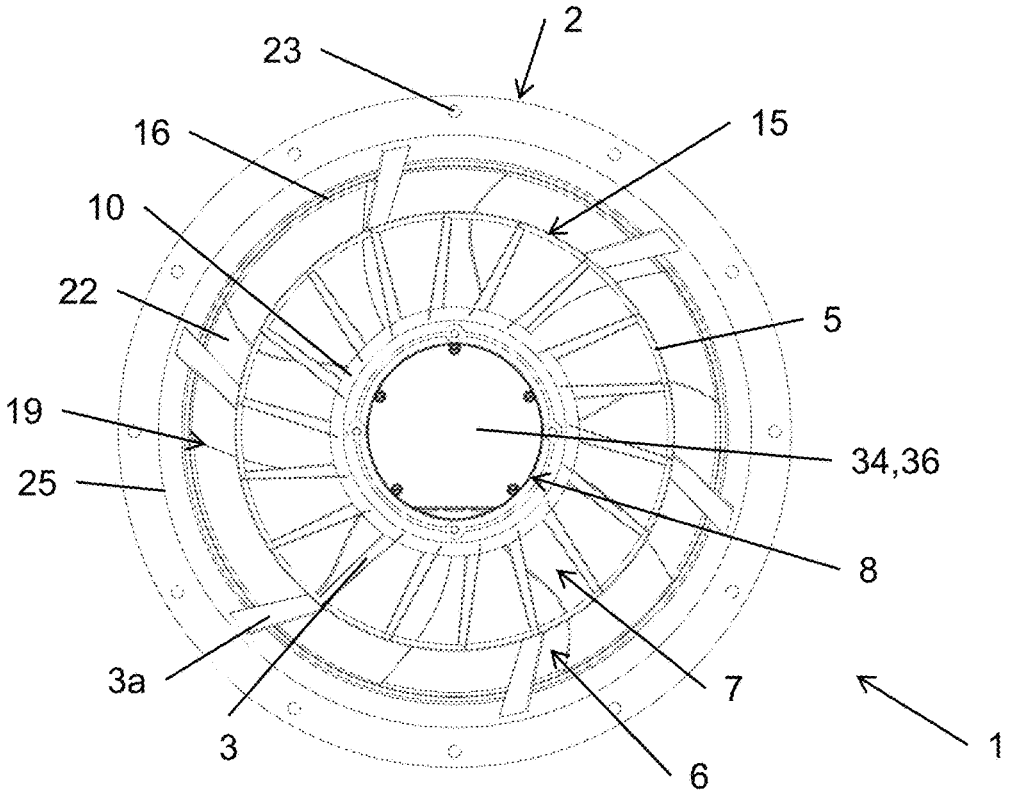
FIG. 8 shows, in a planar view, as seen from the outflow side, the fan from FIGS. 1 to 4.

FIG. 8 shows, in a planar view, as seen from the outflow side, the fan 1 from FIGS. 1 to 4. As a supplement to FIGS. 1 to 4, it can easily be seen that the strut blades 3*a*, as far as their radial profile is concerned, are twisted/tilted relatively strongly compared to an imaginary radial beam starting from the fan axis. Advantageously, in an embodiment, in a planar projected rear view according to FIG. 8, the angle between the inflow edge of the strut blades 3*a* and an imaginary radial beam, which emanates from the fan axis, is overall or on average greater than 25°. The strut blades 3*a* may also be said to be greatly inclined or sickle-shaped. This leads to a reduced generation of rotational sound. In the exemplary embodiment, the strut blades 3*a* are inclined counterclockwise in a direction from radially on the inside to the outside, counter to the direction of rotation of the impeller. However, they may also be inclined in the other direction. All of the strut blades 3*a* are inclined in the same direction. In contrast thereto, the inner guide elements 3 are slightly inclined to the radial direction. Since, in a radially inner region, the velocities occurring in the circumferential direction (local rotational velocity of the blades 22 of the impeller 19 or flow velocities) are rather lower, the generation of rotational sound is of secondary importance here. The more radial alignment of the inner guide elements 3, on the other hand, is advantageous for the static rigidity, in particular since the inner guide elements 3 also have a supporting function.

Figure 9:
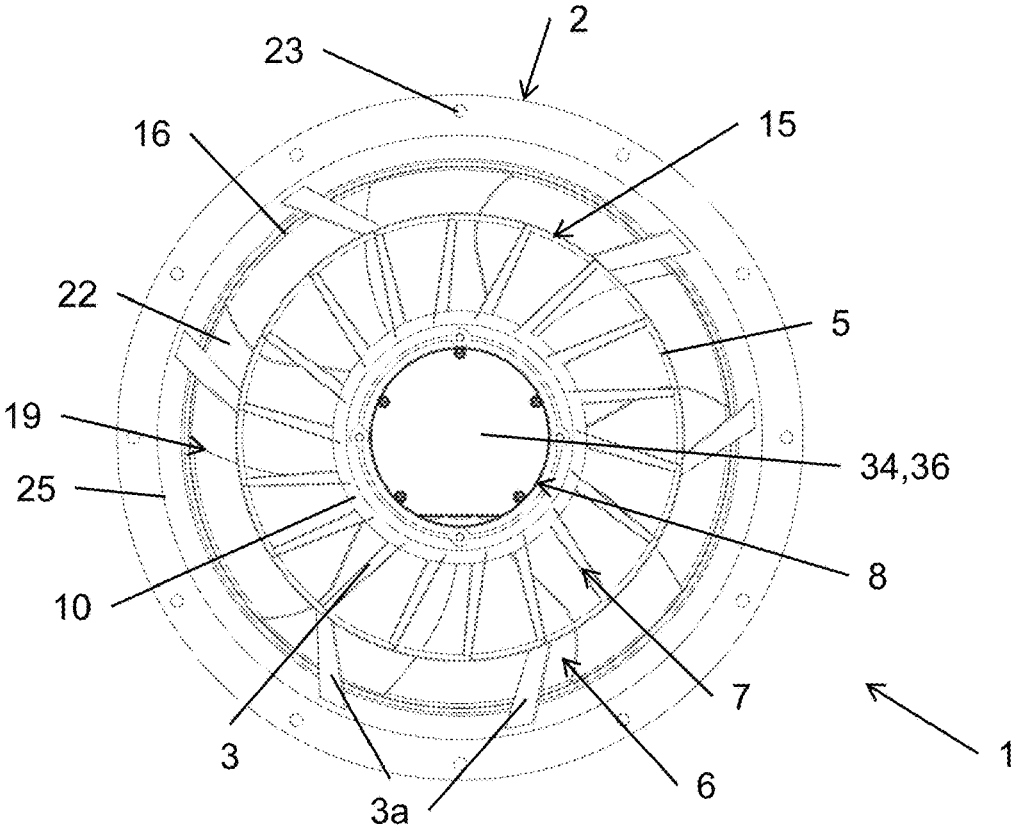
FIG. 9 shows, in a planar view, as seen from the outflow side, a further fan according to the disclosure, in which the strut elements have an alternating direction of inclination.

FIG. 9 shows, in a planar view, as seen from the outflow side, a further embodiment of a fan 1 according to the disclosure, in which the strut elements 3*a* have an alternating direction of inclination in the circumferential direction. Each of the strut elements 3*a*, in particular as viewed at the leading edges or the trailing edges, is greatly inclined in relation to the radial direction. However, the direction of inclination, i.e. the sign of the angle of inclination, changes from strut to strut. This can be advantageous for the rigidity of the system, because the strut blades 3*a* are designed here to be supporting, i.e. they take on the static connection of the motor 34 to the impeller 19 toward the outside of the housing 2. Owing to the changing direction of inclination of the strut blades 3*a*, mutual reinforcement is achieved similarly to that of a latticework structure. Otherwise, the design corresponds to FIGS. 1 to 4 and 8.

Figure 10:
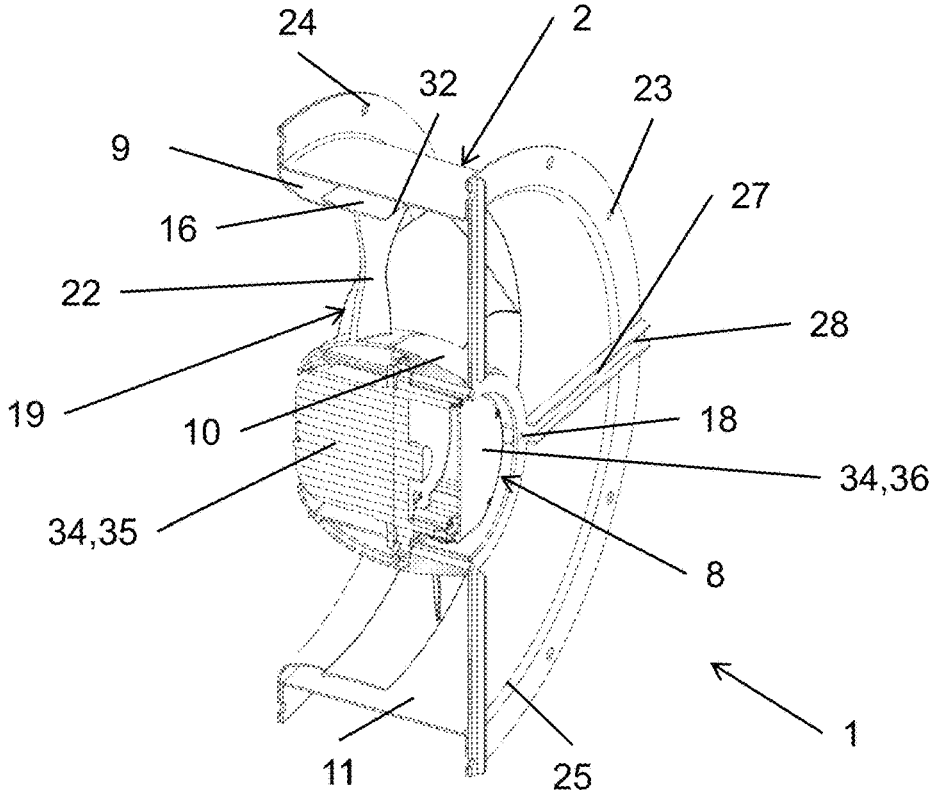
FIG. 10 shows, in a perspective view, as seen from the outflow side and in a section at a plane through the fan axis, a further embodiment of a fan according to the disclosure, with no direction device being provided and a suspension taking on the supporting function.

FIG. 10 shows, in a perspective view, as seen from the outflow side and in a section at a plane through the fan axis, a further embodiment according to the disclosure of a fan 1, with no guide device being provided. The suspension 27 takes on the supporting function. It is advantageously, in an embodiment, made of steel or another metallic material and therefore achieves the necessary rigidity with small cross-sectional surfaces, thereby minimizing the generation of noise. Such a suspension may also be inclined in the radial direction and/or have an aerodynamically optimized cross-sectional shape. It is also conceivable for a touch protection grille to be integrated in the suspension. The suspension 27 is fastened, advantageously screwed, to the housing 2 in an embodiment by way of fastening devices 28. A type of step diffuser is formed downstream of the outflow-side edge 32 of the surrounding cover ring 16 of the impeller 19 for the main flow, since the flow cross section rather abruptly extends to the larger cross section of the inner contour 11 of the housing 2.

Figure 11:
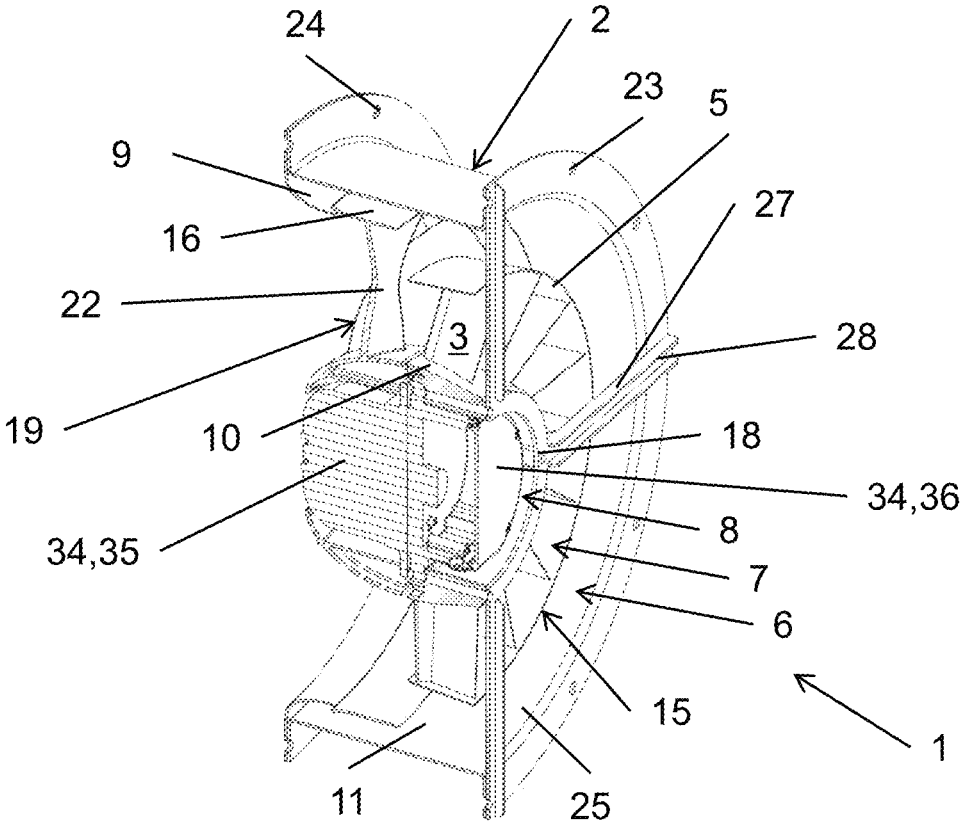
FIG. 11 shows, in a perspective view, as seen from the outflow side and in a section at a plane through the fan axis, a further embodiment of a fan according to the disclosure, with an inner direction device being provided and a suspension taking on the supporting function.

FIG. 11 shows, in a perspective view, as seen from the outflow side and in a section at a plane through the fan axis, a further embodiment according to the disclosure of a fan 1, with an inner guide device 15 being provided and a suspension 27 taking on the supporting function. Strut blades 3*a* are consequently not formed. The embodiment is similar to that shown in FIG. 10, except for the inner redirection wheel 15 which is formed, with an intermediate ring 5 and guide elements 3, which prevents or reduces a backflow in the hub region and thus increases the efficiency.

With respect to further advantageous refinements of the fan according to the disclosure, reference is made to the general part of the description and to the accompanying claims to avoid repetition.

Finally, it should be expressly pointed out that the above-described exemplary embodiments of the fan according to the disclosure serve merely for discussion of the claimed teaching, but do not restrict it to the exemplary embodiments.

LIST OF REFERENCE SIGNS

1 Fan
2 Housing
3 Guide element, guide blade
3*a* Strut element
4 Hub ring, inner ring of the guide device
5 Intermediate ring of a guide device
6 Outer throughflow region
7 Inner throughflow region
8 Receiving region inside the hub ring
9 Inlet nozzle
10 Hub ring of a guide device
11 Inner contour of the housing
12 Outlet diameter of the housing
13 Outlet diameter of the impeller
14 Outlet diameter of the inlet nozzle
15 Guide device
16 Surrounding cover ring of an impeller
17 Openings in housing
18 Fastening device for suspension on the inside
19 Impeller
20 Swirl correction elements
20*a* Long swirl correction elements
21 Hub ring of the impeller
22 Blade of the impeller
23 Fastening housing outflow side
24 Fastening housing inflow side
25 Outflow-side edge of the housing
26 Axis of the fan
27 Suspension
28 Fastening device for suspension on the outside
30 Fastening device for motor on the impeller
31 Cover ring outflow direction
32 Outflow-side edge of the surrounding ring
34 Motor
35 Rotor of the motor
36 Stator of the motor
37 Outflow-side edge of the inlet nozzle

The invention claimed is:

1. A fan, comprising:

a housing with a cylindrical inner contour, wherein the housing and the cylindrical inner contour terminate at a housing outflow-side edge;

an impeller arranged in the housing and rotationally driven by an electric motor, with blades extending between a hub ring and a cover ring, wherein the cover ring surrounds the blades;

wherein the inner contour of the housing and a cover ring outflow-side edge of the cover ring define a step diffuser forming an abrupt expansion in a flow cross section formed downstream of the impeller between the cover ring outflow-side edge of the cover ring and the cylindrical inner contour of the housing in the flow direction, wherein a contour of the cover ring interacts with the cylindrical inner contour of the housing with respect to a main flow and a secondary flow through the fan and an imaginary extension of the contour of the cover ring does not intersect the cylindrical inner contour of the housing prior to the housing outflow side edge; and a guide device having a plurality of guide blades is arranged downstream of the impeller in the flow direction, wherein the guide device is configured to influence the flow in the region of the step diffuser.

2. The fan as claimed in claim 1, wherein a diameter of the cylindrical inner contour is >=110% of the diameter of the contour of the cover ring.

3. The fan as claimed in claim 1, wherein the cover ring and the cylindrical inner contour of the housing are configured such that the main flow flows through an inlet nozzle into the impeller and flows through the housing via inner and outer throughflow regions, and the secondary flow, as a partial flow of the air emerging from the impeller, flows back between the cover ring and the cylindrical inner contour of the housing and enters the region of the impeller again via a radial gap between the inlet nozzle and the cover ring.

4. The fan as claimed in claim 1, wherein a supporting redirection device is integrally integrated on the housing and the housing is manufactured by plastics injection molding.

5. The fan as claimed in claim 1, wherein a supporting function for the motor and impeller is taken on by a suspension, made of steel or another metallic material.

6. The fan as claimed in claim 1, wherein the hub ring of the impeller has a large central opening toward a rotor of the motor for cooling purposes.

7. The fan as claimed in claim 1, wherein a ratio of an outlet diameter of the housing at its outflow-side edge to an inner outlet diameter of the cover ring of the impeller is greater than 1.05.

8. The fan as claimed in claim 1, wherein the cover ring of the impeller extends beyond a region approximately parallel to an impeller axis or with a small pitch angle with respect to the impeller axis, and wherein the hub ring of the impeller has a conical profile with a diameter increasing in the flow direction.

9. The fan as claimed in claim 1, wherein an outlet diameter of an inlet nozzle is at least slightly smaller than an outlet diameter at the cover ring of the impeller, and a ratio of outlet diameter from the housing to outlet diameter of the inlet nozzle is greater than 1.05.

10. The fan as claimed in claim 1, wherein openings are formed in the housing, the openings fluidically connecting a region associated with a secondary flow between an inlet nozzle or the cover ring of the impeller and the housing to a region outside the housing.

11. The fan as claimed in claim 1, wherein the fan is an axial or diagonal fan.

12. The fan as claimed in claim 1, wherein the guide device further comprises a hub ring and an intermediate ring, wherein the plurality of blades extend between the hub ring and the intermediate ring.

13. The fan as claimed in claim 1, wherein the cover ring, radially outward in the vicinity of an outflow-side edge, has a pitch angle with respect to a fan axis.

14. The fan as claimed in claim 13, wherein the angle is between 5° and 15°.

* * * * *